US010517372B2

(12) United States Patent
Tarling

(10) Patent No.: US 10,517,372 B2
(45) Date of Patent: Dec. 31, 2019

(54) WIPER ASSEMBLY

(71) Applicant: L'Oreal, Paris (FR)

(72) Inventor: Christopher Tarling, Brooklyn, NY (US)

(73) Assignee: L'Oreal, Paris (FR)

( * ) Notice: Subject to any disclaimer, the term of this patent is extended or adjusted under 35 U.S.C. 154(b) by 107 days.

(21) Appl. No.: 15/693,288

(22) Filed: Aug. 31, 2017

(65) Prior Publication Data

US 2019/0059553 A1 Feb. 28, 2019

(51) Int. Cl.
*A45D 34/04* (2006.01)
*A45D 40/26* (2006.01)

(52) U.S. Cl.
CPC ..... *A45D 34/046* (2013.01); *A45D 40/267* (2013.01)

(58) Field of Classification Search
CPC .. A45D 34/046; A45D 40/267; A45D 34/047; A45D 34/045; A45D 34/042; A45D 40/262; A45D 40/264; A45D 40/265; A45D 40/268
See application file for complete search history.

(56) References Cited

U.S. PATENT DOCUMENTS 4,859,712 A * 8/1989 Cox ..... A61L 27/34 521/62
5,190,389 A * 3/1993 Vasas ..... A45D 34/046 401/122
6,076,985 A * 6/2000 Gueret ..... A45D 34/046 401/121
6,298,864 B1 10/2001 Gueret
6,305,861 B1 10/2001 Gueret
8,142,093 B2 * 3/2012 Vanoncini ..... A45D 40/267 401/121
8,721,210 B2 * 5/2014 Wilczynski ..... A45D 40/267 401/122
10,051,939 B2 * 8/2018 Matsui ..... B29C 45/16
(Continued)

FOREIGN PATENT DOCUMENTS

EP 1 196 062 B1 10/2005
EP 2 202 042 A1 6/2010
FR 2 992 839 A1 1/2014

OTHER PUBLICATIONS

International Search Report and Written Opinion dated Dec. 5, 2018, in corresponding International Application No. PCT/EP2018/072871, filed Aug. 24, 2018, 12 pages.

*Primary Examiner* — David J Walczak
(74) *Attorney, Agent, or Firm* — Christensen O'Connor Johnson Kindness PLLC

(57) ABSTRACT

A wiper assembly includes a non-porous base configured for attachment to an open end of a container body and a porous wiper overmolded onto the base that is configured to wipe formulation from an applicator when removed from the container body.

A wiper assembly includes a collar configured to be positioned within an open end of a container body. The collar includes a substantially cylindrical shaped base portion having a top opening and a substantially dome-shaped secondary wiper portion extending from the base portion that has a bottom opening defining at least one secondary wiper edge. A sponge is configured to be disposed beneath the secondary wiper portion of the collar that has an opening in substantial axial alignment with the top and bottom openings of the collar.

15 Claims, 8 Drawing Sheets

(56) References Cited

U.S. PATENT DOCUMENTS

| | | | |
|---|---|---|---|
| 2012/0128401 | A1 | 5/2012 | Wilczynski |
| 2014/0016983 | A1 | 1/2014 | Kim |
| 2016/0073763 | A1 | 3/2016 | Matsui |
| 2016/0174689 | A1 | 6/2016 | Wilczynski |

* cited by examiner 3B
136
144
140
148
132
160
124
130
152
3B 136
144
140
148
132
160
124
130
152
164

174
182
184
170
178
128

WIPER ASSEMBLY

SUMMARY

In one aspect, a wiper assembly includes a non-porous base configured for attachment to an open end of a container body and a porous wiper overmolded onto the base that is configured to wipe formulation from an applicator when removed from the container body.

In another aspect, a wiper assembly includes a collar configured to be positioned within an open end of a container body. The collar includes a substantially cylindrical shaped base portion having a top opening and a substantially dome-shaped secondary wiper portion extending from the base portion that has a bottom opening defining at least one secondary wiper edge. A sponge is configured to be disposed beneath the secondary wiper portion of the collar that has an opening in substantial axial alignment with the top and bottom openings of the collar.

In one embodiment, the top opening of the substantially cylindrical shaped base portion may be less than about 9 mm.

In one embodiment, the bottom opening of the substantially dome-shaped secondary wiper portion is less than about 5 mm.

In one embodiment, the at least one secondary wiper edge of the substantially dome-shaped secondary wiper portion extends substantially axially along the collar.

In one embodiment, the opening in the sponge is substantially cylindrical in shape.

In one embodiment, the opening in the sponge includes a flared upper opening.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Cosmetic formulations or other formulations are often applied to a person's face, hair, skin, nails, etc., with an applicator. The applicator configuration will depend on the intended end use, but it may include an applicator element defined by a brush, sponge, bristle, molded portion, etc. Many formulations can only be applied properly if the applicator element is wiped in satisfactory manner. If the applicator element is wiped excessively, then the user needs to reload it frequently with the formulation. In contrast, incomplete wiping leaves excess formulation on the applicator element, thereby making it difficult to apply, and causing formulation to be wasted. In particular, the formulation can dry on the stalk and form a solid residue that is liable to flake off and produce solid fragments that spoil the quality of the formulation.

Figure 1:
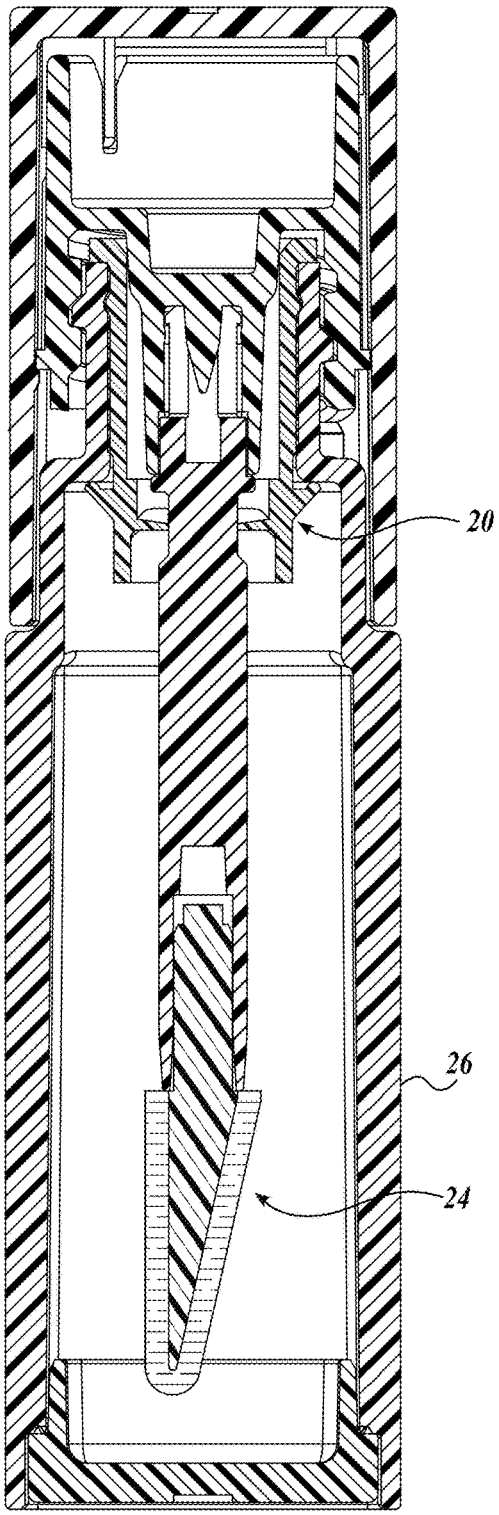
FIG. 1 (PRIOR ART)
FIG. 1 is a cross-sectional view of a prior art cosmetic container having an applicator and a wiper assembly.

Wipers exist for removing formulations from applicators. Many existing wipers are formed of a single material, and are configured to be retained by a cosmetic container (e.g., a bottle), while also being configured to remove product from an applicator. For instance, an exemplary prior art mascara wiper 20 shown in FIG. 1 is formed of a single material designed to be pliable enough to provide interference between the wiper 20 and an applicator 24 to remove mascara from the applicator 24, while being hard enough to be easily installed and retained in an open end of a container body 26 during use (e.g., installed by a snap or press fit). More specifically, the wiper 20 has a hardness (i.e., durometer) that provides for being installed/retained in the container, while at the same time being supple enough to remove mascara from the applicator 24. However, because single material wipers must compromise between providing an adequately supple wiping surface, while at the same time, providing an adequately stiff retaining surface, they do not perform either function well.

Accordingly, there remains a need in the art for improved wipers that provide installation characteristics, while simultaneously providing wiping characteristics.

Figure 2:
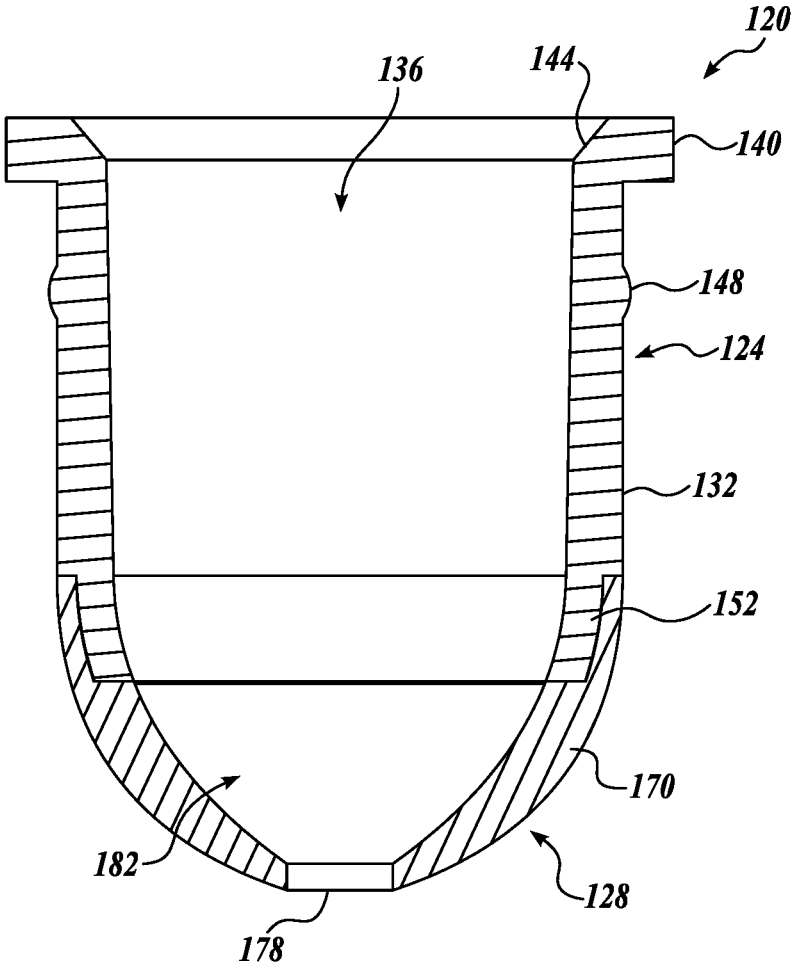
FIG. 2 is a cross-sectional view of a wiper assembly formed in accordance with an exemplary embodiment of the present disclosure.

A wiper assembly 120 formed in accordance with an exemplary embodiment of the present disclosure is shown in FIGS. 2-3. The wiper assembly 120 is generally configured as a bi-injected assembly having a wiper 128 overmolded onto a base 124, wherein the wiper 128 is made from a porous material and the base 124 is made from a non-porous material.

Figures 3A, 3B, 3C:
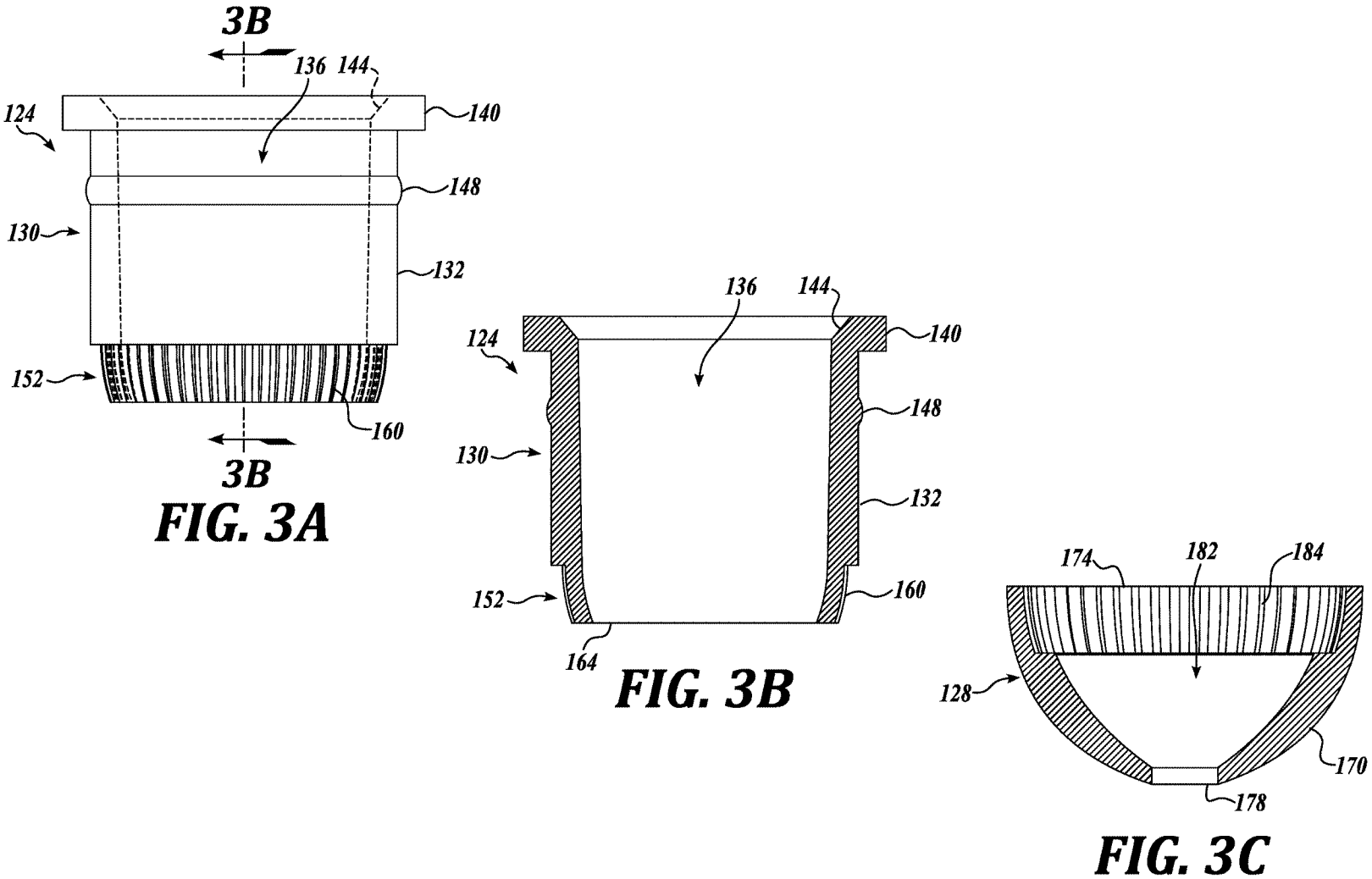
FIG. 3A is a front elevational view of a base of the wiper assembly of FIG. 2.
FIG. 3B is a cross-sectional view of the base of FIG. 3A, taken substantially across line 3B-3B.
FIG. 3C is a cross-sectional view of a wiper of the wiper assembly of FIG. 2.

Referring specifically to FIGS. 3A and 3B, the base 124 includes a retention portion 130 that is generally configured to be installed and retained within an open end of a container, such as the container shown in FIG. 1. It should be appreciated that the retention portion 130 may be any suitable shape and configuration to be installed and retained within a desired container. In the depicted embodiment, the retention portion 130 includes a cylindrical body 132 extending substantially along an axial length of the base 124 and having a hollow cylindrical interior bore 136 passing axially therethrough. The interior bore 136 terminates at its upper end in a flared upper opening 144, which helps guide any applicator tip of an applicator through the wiper assembly 120 and into the container.

The retention portion 130 includes a flanged collar 140 at the upper end of the cylindrical body 132 that has an outer diameter larger than the outer diameter of the cylindrical body 132 to define a shoulder for resting on an upper edge of a container body. The flanged collar 140 may be secured to the upper end of the container body (such as by adhesive or other means) to help retain the base 124 within the container body. In addition or in the alternative, an annular protrusion 148 may extend circumferentially around the cylindrical body 132 for being received within a correspondingly shaped annular groove on the interior of the container body for retaining the base 124 axially in its position within the container body.

A bonding portion 152 extends downwardly from the bottom end of the retention portion 130 and is configured to adhere to the overmolded wiper 128 during the molding process. In that regard, the bonding portion 152 further includes a plurality of exterior ridges 160 extending substantially axially along the length of the bonding portion 152 and around its circumference. The ridges 160, in comparison to smooth, partial dome-shaped exterior surface, provide a maximized surface area for adhering the bonding portion 152 to the overmolded wiper 128. The ridges 160 may have any suitable cross-sectional shape, such as triangular. Other suitable cross-sectional shapes may include curved, rectangular, trapezoidal, etc. The bonding portion 152 terminates in a bottom opening 164 that is in communication with the interior bore 136 of the body 132 and configured to be in communication with a hollow interior of the wiper 128, as shown in FIG. 2.

The bonding portion 152 has a smaller outer diameter than the cylindrical body 132 of the retention portion 130. As such, the wiper 128 may be molded on the bonding portion 152 such that the wiper 128 has a suitable thickness and is substantially flush with the outer diameter of the cylindrical body 132. However, it should be appreciated that in other embodiments, the bonding portion 152 may have any suitable outer diameter, with the wiper 128 substantially flush or not flush with the cylindrical body 132 of the retention portion 130.

Referring to FIG. 3C, the wiper 128, which is overmolded onto the base 124 but shown separately for clarity, generally includes a dome-shaped body 170 having an upper opening 174 that is substantially the same size as and is in communication with the bottom opening 164 of the base 124, and a bottom opening 178 defined opposite the upper opening 174. A hollow dome-shaped interior 182 extends between the upper opening 174 and the bottom opening 178. A plurality of interior ridges 184 are defined around the circumference of the upper open end of the wiper 128 that substantially correspond in shape, size, position, etc., to the exterior ridges 160 of the base 124. In other words, the interior ridges 184 of the wiper 128 are defined when the wiper 128 is overmolded onto the base 124.

As noted above, the wiper 128 is made from a porous material and the base 124 is made from a non-porous material. In one embodiment, the wiper 128 comprises a material having holes and/or pores capable of retaining a liquid or a flowable solid, such as a typical cosmetic formulation. The porous wiper 128 may serve as a device for receiving and retaining such a composition, as in a sponge, or function as an equivalent thereof. The porous wiper 128 may be made from an elastomer.

The base 124, or non-porous part, is a solid material. The base 124 may optionally be formed of the same base material as the porous part or wiper 128, such as an elastomer. In one embodiment, the material of the base 124 and wiper 128 may be a polymer, such as a synthetic polymer or a natural polymer or a combination thereof. The material used may possess some degree of elasticity in order for the pores of the porous wiper 128 to be compressed to absorb and dispense the cosmetic. For example, the base material may be an elastomer, such as polyethylene, polypropylene, propylene, styrene-ethylene/butylene-styrene polymers or a thermo polymer, such as a thermoplastic polyester elastomers and thermoplastic vulcanizates.

The porous wiper 128 may be attached to the base 124 using a molding process. In one example, the molding process is completed by providing the base 124 in the mold, and then over-molding the porous wiper 128 to form a unitary structure. This process creates a secure bond between the wiper 128 and the base 124 without requiring the need for a separate adhesive. The solid part or base 124 may be made using a different process, such as by way of injection molding.

The porous wiper 128 may not initially be porous (including during the formation process, such as overmolding), but instead may be of the same material as the solid part with the addition of a soluble filler. Specifically, the porous wiper 128 may comprise a water soluble filler that is absent from the solid base 124. Accordingly, upon contact with water or a water-based solution, the filler dissolves and pores remain, thereby rendering it capable of functioning as a sponge for absorbing or applying the cosmetic without affecting the solid base 124. As can be appreciated, it is possible to vary the pore sizes within the intended porous wiper 128. Both the type of filler or fillers used, as well as the concentrations thereof, will determine the pore size and number.

Further details of a molding process suitable for overmolding the porous wiper 128 onto the solid base 124 are illustrated and described in U.S. Patent Publication No. 2016/0073763, published on Mar. 17, 2016, entitled "Cosmetic Devices, Precursor Therefor and Related Methods," the entire disclosure of which is incorporated by reference herein. Any of the processes, materials, fillers, etc., described or illustrated in U.S. Patent Publication No. 2016/0073763, may be used.

In one embodiment, the base portion 124 and the wiper 128 are injection molded with polyethylene (PE). Using the same material for the base and the wiping portion 124 and 128, the porous wiper 128 remains bonded to the non-porous base 124 after the wiper 128 is bathed in a water-based solution to dissolve the fillers and produce pores. To increase the adhesion strength between the porous wiper 128 and the non-porous base 124, the surface area defining the adhesion is maximized using the outer ridges 160 of the base 124 and the interior ridges 184 that are defined on the wiper 128 when it is overmolded onto the base 124. As can be appreciated, the surface area between the wiper 128 and the base 124 is increased with the use of the ridges in comparison to merely using a cylindrical surface area for adhesion between the two parts. Maximum adhesion between the porous wiper 128 and the non-porous base 124 was found to be needed by the inventors for providing a wiping assembly having a porous wiper molded onto a non-porous base that would withstand everyday use, potentially used multiple times a day, and over a period of many months (such as in a mascara wiper, lip gloss, etc.).

Figure 4:
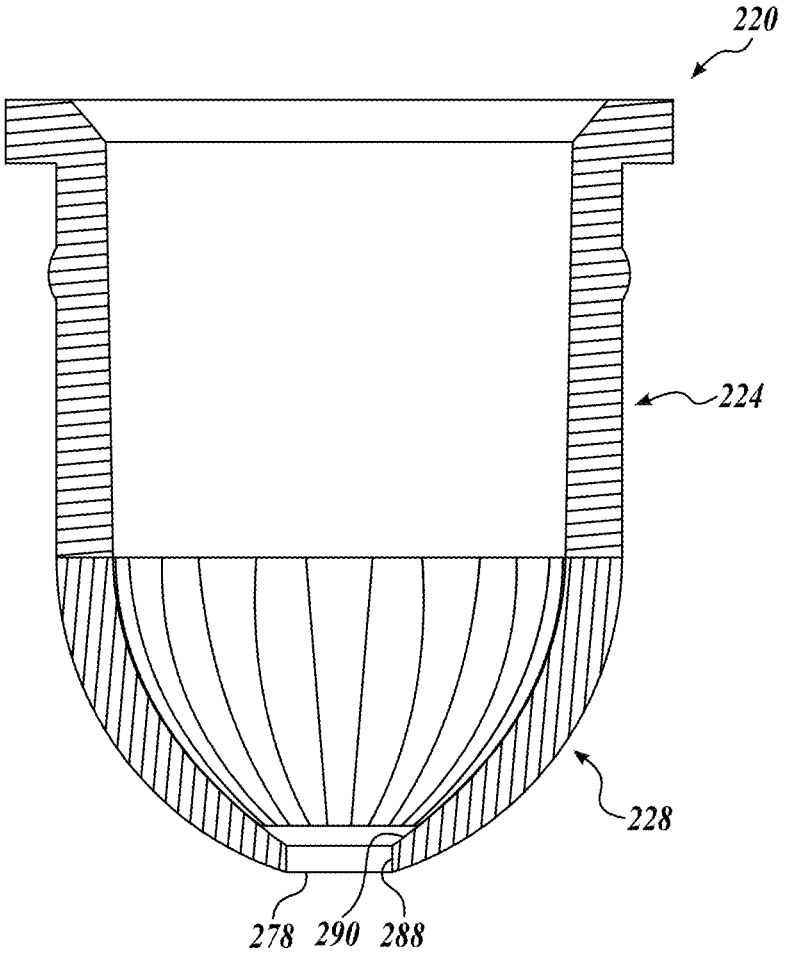
FIG. 4 is a cross-sectional view of a wiper assembly formed in accordance with an alternative exemplary embodiment of the present disclosure.
Figure 5A:
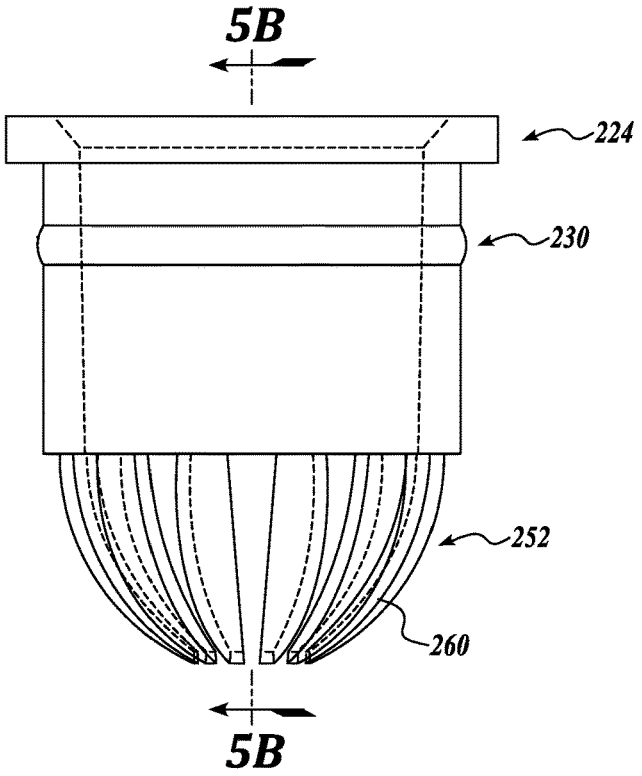
FIG. 5A is a front elevational view of a base of the wiper assembly of FIG. 4.
Figure 5B:
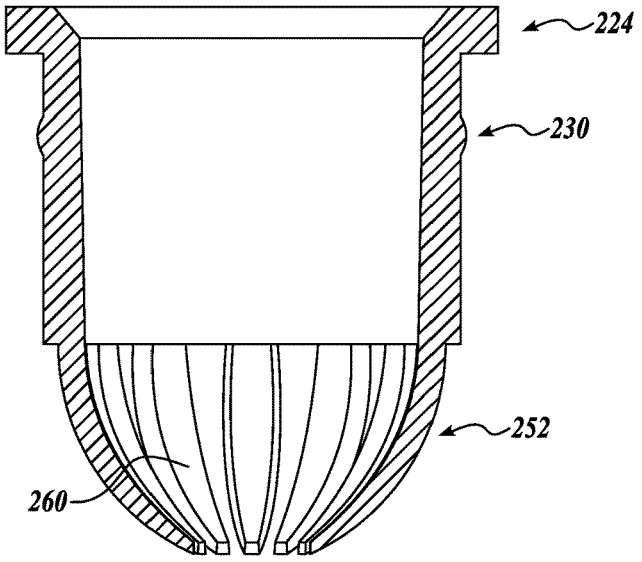
FIG. 5B is a cross-sectional view of the base of FIG. 5A, taken substantially across line 5B-5B.
Figure 6:
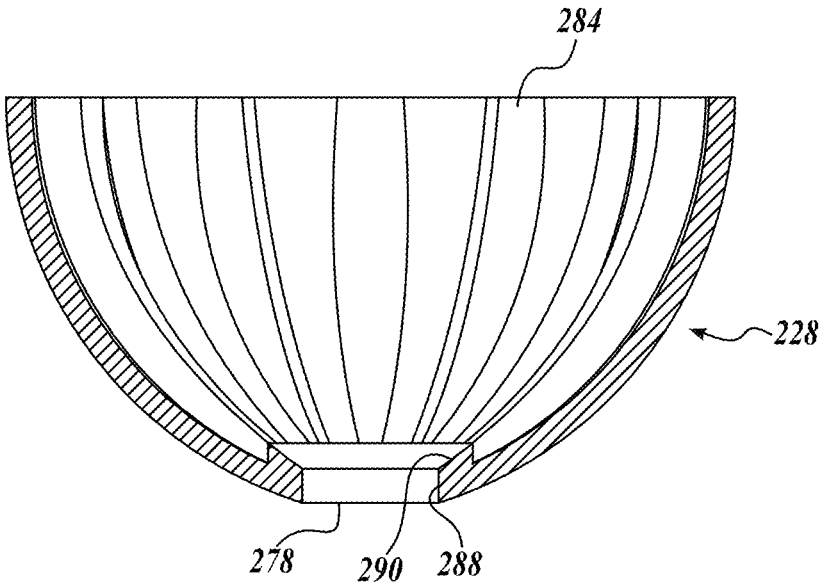
FIG. 6 is a cross-sectional view of a wiper of the wiper assembly of FIG. 4.

In that regard, another exemplary embodiment of a wiping assembly 220 is depicted in FIGS. 4-6 where the wiping assembly includes a maximized surface area for bonding between a non-porous base 224 and a porous wiper 228 through a plurality of elongated axially extending fingers 260. The wiping assembly 220 is substantially identical to the wiping assembly 120 described above, except for the differences hereinafter noted. In that regard, certain like parts have been numbered with like reference numerals except in the '200 series. Moreover, the wiping assembly 220 may be made using the molding process described above.

The base 224 includes a retention portion 230 configured to be installed and retained within a suitable container body in a substantially identical manner to the retention portion 130 of the base 124. The base 224 further includes a bonding portion 252 extending downwardly from the retention portion 230 that is defined by the plurality of axially extending fingers 260. The fingers 260 extend axially along a length of the bonding portion 252 and are curved inwardly at their bottom ends to define an overall dome-shaped bonding portion 252. The fingers 252 do not touch at their ends but instead define a substantially circular opening (not labeled). As such, when the wiper 228 is overmolded onto the bonding portion 252 of the base 224, a bottom opening 278 is defined within the wiper 228.

The second mold used to overmold the wiper 228 onto the base 224 may also be configured to define a substantially straight, coaxial first wiping edge 288 surrounding and extending upwardly from the bottom opening 278, and a second flared wiping edge 290 extending upwardly and radially outwardly from the first wiping edge 288 to help guide any applicator tip into the bottom opening 278. As noted above with the wiping assembly 120, any suitable bottom opening and wiping edge or edges may instead be used. Moreover, any of the other variations noted above with respect to the wiping assembly 120 may also be incorporated into the wiping assembly 220.

It can be appreciated that instead of ridges or axial fingers, various other shapes, surface textures, etc., may instead be used to create a bond between the porous wiper and the non-porous base of the wiping assembly. For instance, a larger adhesive surface area, such as that shown in the wiping assembly 220, may be used for wipers intended for wiping formulas of higher viscosity, for wiping larger applicator tips, etc. Moreover, while the wiping portions 128 and 228 include a bottom opening having a vertical wiping surface, other wiping surfaces are contemplated, such as a beveled surface, a textured surface (e.g., dimples, bumps, etc.), one or more ridges, or the like that is suitable for removing product from an applicator. Moreover, although the wiping assemblies 120 and 220 are described as only having a single base with a wiper overmolded on the base, other configurations having multiple base pieces and/or multiple overmolded portions may instead be used, either all of the same type of material or with different types of materials.

Further, certain dimensional aspects and shapes of the wiping assembly have been found to be beneficial (through experimentation by the inventors) for effectively wiping a mascara brush. For instance, the upper opening of the base 124 or 224 (with only upper opening 144 labeled in FIGS. 2, 3A, and 3B), in some embodiments, may be a maximum inner diameter of about 9 mm. The inventors found that larger top openings in the base cause buildup and messiness on the stem and applicator tip of the applicator. With a larger opening at the top of the base, the base can provide too much of a flat surface along the hollow interior of the base, allowing for too much formulation buildup. Moreover, with a wider top opening in the base, the wiper is more exposed, leading to further buildup on the wiper. Accordingly, the inventors found that a top opening inner diameter of less than about 9 mm is ideal for mascara applications using a 2.6 mm stem or a 3 mm stem. The inventors further found that a maximum inner diameter of about 5 mm at the bottom opening of the wiping assembly is ideal for effectively wiping the applicator tip and preventing buildup. In some embodiments, the bottom opening is about 2 mm, 3 mm, or 4 mm. In any event, the bottom opening is sized to define a suitable dimensional interference between the applicator and the wiping edge(s) as the applicator is drawn out of the container to effectively remove product from the stem and brush of the applicator.

Figure 7:
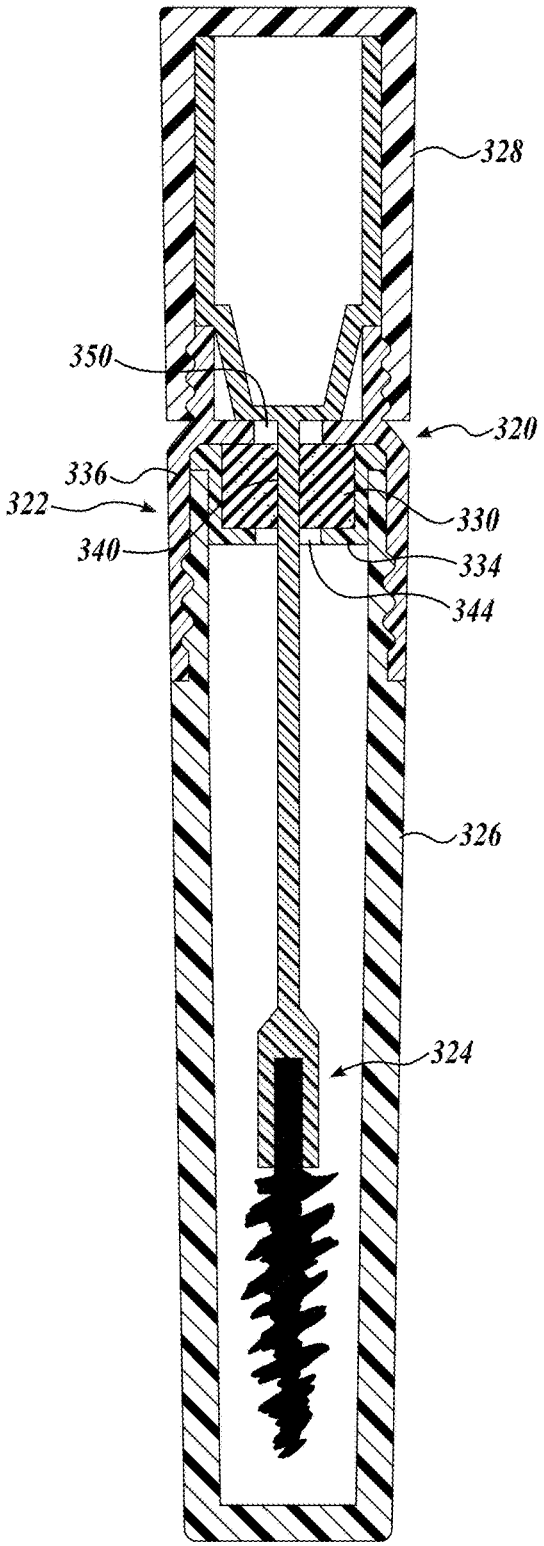
FIG. 7 is a cross-sectional view of a cosmetic container having an applicator and a wiper assembly formed in accordance with an alternative exemplary embodiment of the present disclosure.
Figure 8:
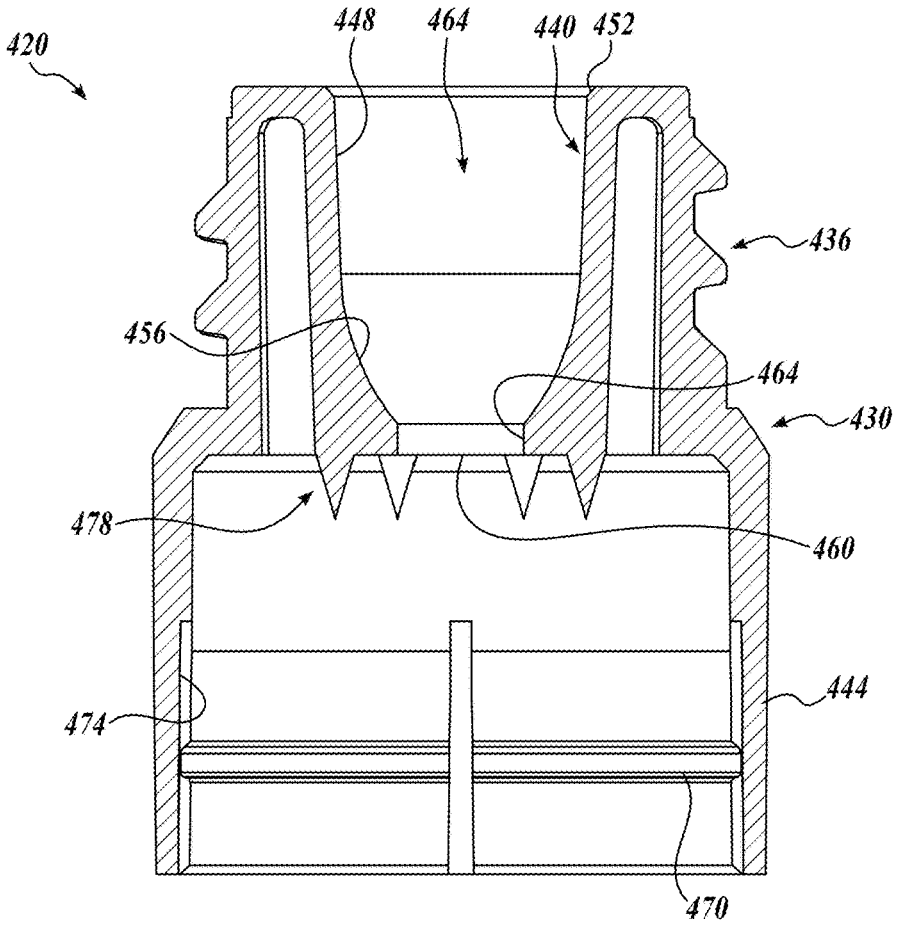
FIG. 8 is a cross-sectional view of a portion of a wiper assembly formed in accordance with an alternative exemplary embodiment of the present disclosure.
Figure 9:
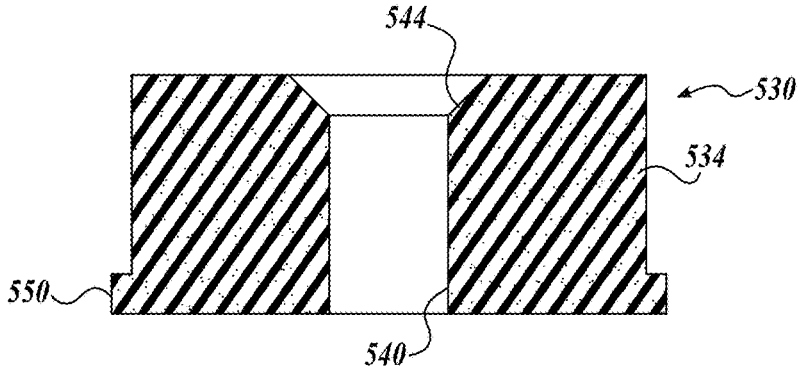
FIG. 9 is a cross-sectional view of a portion of a wiper assembly formed in accordance with an alternative exemplary embodiment of the present disclosure.

Referring to FIGS. 7-9, another exemplary embodiment of a wiping assembly 320 and some alternative components of the wiping assembly 320 will be hereinafter described. Referring to FIG. 7, the wiping assembly 320 is shown embodied within a container assembly 322 having a container body 326 and a cap 328 removably secured thereon, with an applicator 324 extending from the cap 328 into the interior of the body 326.

The wiping assembly 320 is defined at the upper end of the container body 326 and includes a sponge 330 sandwiched between a sponge housing 334 installed within the upper open end of the container body 326 and a container end cap 336 threadably secured on the upper open end of the container body 326 over the sponge housing 334 (and thereby retaining the sponge housing 334 within the container body 326). The sponge 330 includes a central opening or hole 340 sized to define a dimensional interference between the applicator 324 and the sponge 330 as it is drawn out of the container 326 to remove product from the stem and brush of the applicator 324 as desired. In that regard, the applicator 324 is also configured to pass through a sponge housing opening 344 defined within the sponge housing 334 and an end cap opening 350 defined within the container end cap 336 that are substantially coaxially aligned with the hole 340 in the sponge 330.

The sponge 330 may be any suitable open or closed cell foam suitable for wiping the desired cosmetic formula or other formulation from the applicator 324 as it is drawn out of the container 326. The sponge 330 may be held in its position between the sponge housing 334 and the end cap 336 by suitable means, such as through spikes extending from the sponge housing 334 and/or the container end cap 336, as will be described with reference to FIG. 8, through adhesive, laser weld, sonic welding, or the like.

Referring to FIG. 8, an alternate embodiment of a wiping assembly 420 for use with the container body 326 shown in FIG. 7, or any other suitable container requiring a wiping assembly will now be described. The wiping assembly 420 includes a container end cap assembly 430 having at its upper end an exterior cap engaging portion 436 surrounding an interior collar 440 that is generally configured to guide an applicator into and out of a container body. The cap engaging portion 436 is configured to be selectively attached to a cap or other assembly for enclosing the container body, such as by threading or otherwise.

The wiping assembly 420 further includes an end cap portion 444 extending downwardly from the cap engaging portion 436. The end cap portion 444 is generally shaped to be mated with or otherwise installed on an end of a container body. In that regard, the end cap portion 444 may include an interior annular groove 470 configured to receive a correspondingly shaped annular protrusion on a container body, as well as an annular recess 474 configured to receive an upper portion of the container body.

The collar 440, which is coaxially positioned within the cap engaging portion 436, is shaped similarly to the wiping assemblies 120 and 220 described above in that it includes an upper interior cylindrically shaped base portion 448 with a flared opening 452 defined at its upper end, and a bottom interior dome shaped secondary wiper portion 456 extending downwardly from the cylindrically shaped base portion 448. The collar 440 has a hollow interior 464 extending along its length that is defined in its shape by the cylindrically shaped base portion 448 and the dome shaped secondary wiper portion 456 to guide an applicator into a container body. The bottom interior dome shaped secondary wiper portion 456 terminates in a bottom opening 460 that defines a substantially axial secondary wiping edge 464.

As noted above with reference to the wiping assemblies 120 and 220, the upper opening 452 may be no larger than about 9 mm, and the bottom opening 460 may be no larger than about 5 mm to prevent buildup of formulation on the applicator. However, in this embodiment of a wiping assembly 420, the cylindrically shaped base portion 448 and dome shaped secondary wiper portion 456 may both be made from a non-porous material. In that regard, a sponge assembly (not shown), is configured to be disposed beneath the collar 440 and on the interior of the end cap portion 444. More specifically, the end cap portion 444 has an interior sized and shaped to receive a sponge, such as sponge 330 shown in FIG. 7, sponge 530 shown in FIG. 9, or another suitable sponge, for wiping formulation from the applicator as it is drawn into and out of a container.

The sponge may be retained within the end cap portion 444 through a plurality of spikes 478 extending substantially axially downwardly from the bottom of the collar 440, which extend at least partially into the sponge to substantially retain its position within the end cap portion 444. A sponge housing (not shown) may be disposed beneath the sponge and received within an upper open end of the container body for securing the lower end of the sponge both in its axial and radial position within the end cap portion 444. In that regard, the sponge housing may also include a plurality of spikes extending substantially axially upwardly therefrom for helping to retain the position of the sponge within the end cap portion 444. The end cap assembly 430 may be suitably molded from a single type of material, or it may be made from separate parts that are subsequently secured together.

To use the wiper assembly 420 (with the end cap assembly 430 secured to a container body), an applicator (e.g., a stem with a tip) is withdrawn from the container body while passing through an opening in the sponge and the collar 440. Dimensional interference between the sponge opening and the applicator causes a wiping action of the applicator. Moreover, the secondary wiping edge 464 defined around the bottom opening 460 of the collar 440 helps wipe any excess formulation from the wiper.

An exemplary sponge 530 suitable for use with the wiping assembly 420 shown in FIG. 8, the wiping assembly 320 shown in FIG. 7, or another suitable wiping assembly will now be described with reference to FIG. 9. The sponge 530 includes a generally cylindrical sponge body 534 that is correspondingly shaped to fit within an end cap portion 444 shown in FIG. 8, within a sponge housing 334 shown in FIG. 7, or similar. It should be appreciated that the sponge body 534 may instead be any other suitable shape and size to fit within a correspondingly shaped container for a desired wiping application.

The sponge body 534 is preferably a suitable closed or open pore blend, an injected open or closed cell sponge, or the like that is suitable to wipe a desired formulation from an applicator. Any suitable sponge material may be used for the intended application, such as styrene-butadiene rubber (SBR), nitrile-butadiene rubber (NBR), blended NBR/SBR, polyurethane (PU), polyethylene (PE), or a similar material. The sponges may be treated by washing with water or another suitable fluid, by heating to a certain temperature, such as between about 20° C. to 40° C. (depending on the hardness desired), by spinning, by drying (for instance, for two hours at 80° C.), etc. It has been shown by the inventors that in a mascara wiping application, a max density of 80 SH (durometer shore hardness) for the sponge body is ideal.

The sponge 530 further includes a central axial hole 540 extending axially along the length of the sponge body 534 to provide a dimensional interference with at least a portion of the applicator for wiping formulation from the applicator. It has been found by the inventors that a hole of a cylindrical shape most beneficially wipes formulation from a mascara applicator or similar, as opposed to a hole having a star shape, a cross shape, a zig-zag shape, etc. In one embodiment, the hole may define a flared upper opening 544 at the upper end of the sponge body 534 for helping to guide the applicator into the hole 540. In one embodiment, the sponge 530 may further include a flanged annular end 550 defined at its upper or lower end for helping to retain the sponge 530 within a housing, end cap portion, etc., wherein the end cap portion or housing would have a correspondingly shaped annular recess.

The detailed description set forth above in connection with the appended drawings is intended as a description of exemplary embodiments of the disclosed subject matter and is not intended to represent the only embodiments. The exemplary embodiments described in this disclosure are provided merely as examples or illustrations of a wiping assembly and should not be construed as preferred or advantageous over other embodiments. The illustrative examples provided herein are not intended to be exhaustive or to limit the disclosure to the precise forms disclosed. Similarly, any features and/or process steps described herein may be interchangeable with other features and/or process steps, or combinations of features and/or process steps, in order to achieve the same or substantially similar result.

In the foregoing description, numerous specific details are set forth in order to provide a thorough understanding of the exemplary embodiment of the present disclosure. It will be apparent to one skilled in the art, however, that many embodiments of the present disclosure may be practiced without some or all of the specific details. In some instances, well-known features, subassemblies, and/or process steps have not been described in detail in order not to unnecessarily obscure various aspects of the present disclosure. Further, it will be appreciated that embodiments of the present disclosure may employ any combination of features described herein. For instance, any feature or configuration described above with respect to one wiping assembly may be adapted for use with any other wiping assembly.

Although certain descriptive terms are used to illustrate or describe certain aspects or benefits of the present invention, they should not be seen as limiting. For instance, the present disclosure also includes references to directions, such as "upper," "lower," "upward," "downward," "top," "bottom," "first," "second," etc. These references and other similar references in the present disclosure are only to assist in helping describe and understand the exemplary embodiments and are not intended to limit the claimed subject matter to these directions. The term "cosmetic formulation" or "cosmetic" should be interpreted broadly to include any cosmetic formulation, beauty product, lotion, lacquer, etc., generally applied to a person's skin, eyes, nails, or other body part. Moreover, it should be appreciated that the wiping assemblies may also be adapted for other non-cosmetic uses, such as applying medicine, paint, etc., to a desired body part or surface.

The present disclosure may also reference quantities and numbers. Unless specifically stated, such quantities and numbers are not to be considered restrictive, but exemplary of the possible quantities or numbers associated with the present disclosure. Also in this regard, the present disclosure may use the term "plurality" to reference a quantity or number. In this regard, the term "plurality" is meant to be any number that is more than one, for example, two, three, four, five, etc. The terms "substantially," "about," "approximately," etc., mean plus or minus 5% of the stated value.

While illustrative embodiments have been illustrated and described, it will be appreciated that various changes can be made therein without departing from the spirit and scope of the invention.

The invention claimed is:

1. A wiper assembly, comprising:

a non-porous base configured for attachment to an open end of a container body; and a porous wiper overmolded onto the base that is configured to wipe formulation from an applicator when removed from the container body, wherein the base includes a retention portion configured for attachment to a container body and a bonding portion configured to be overmolded with the wiper, the bonding portion including a plurality of members each extending individually from the retention portion.

2. The assembly of claim 1, wherein the base and the wiper are made from the same material.

3. The assembly of claim 1, wherein the base and the wiper are made from a material chosen from the group consisting of polyethylene, polypropylene, propylene, styrene-ethylene polymer, butylene-styrene polymer, thermo polymer, and any combination thereof.

4. The assembly of claim 1, wherein the base is formed in a first mold, and the wiper is formed in a second mold.

5. The assembly of claim 4, wherein the wiper is submerged in a bath after being molded to define pores within the wiper.

6. The assembly of claim 5, wherein the base is molded with a first material, and the wiper is molded with the first material having a soluble filler that dissolves in the bath.

7. The assembly of claim 1, wherein the base is substantially cylindrical shaped having a top opening.

8. The assembly of claim 7, wherein the top opening has an inner diameter of less than about 9 mm.

9. The assembly of claim 7, wherein the wiper is substantially dome-shaped having a bottom opening defining at least one wiper edge.

10. The assembly of claim 9, wherein the bottom opening has an inner diameter of less than about 5 mm.

11. The assembly of claim 9, wherein the at least one wiper edge extends substantially axially along a length of the bottom opening.

12. The assembly of claim 1, wherein the bonding portion includes a plurality of axial fingers.

13. The assembly of claim 1, wherein each of the plurality of members each extend axially along a length of the bonding portion.

14. The assembly of claim 1, wherein each of the plurality of members include a first end secured to the retention portion and a second end opposite the first end that is curved inwardly to define an overall dome-shaped bonding portion.

15. The assembly of claim 14, wherein the second ends of the plurality of members cooperatively define a substantially circular opening.

* * * * *